United States Patent [19]

Nakamura et al.

[11] Patent Number: 4,681,989

[45] Date of Patent: Jul. 21, 1987

[54] IGNITION DISTRIBUTOR FOR INTERNAL COMBUSTION ENGINES

[75] Inventors: Naotaka Nakamura, Chita; Kenji Yagi, Nagoya; Shunzo Yamaguchi, Okazaki; Ichirou Yoshida, Kariya; Morihiro Atsumi, Okazaki, all of Japan

[73] Assignee: Nippondenso Co., Ltd., Kariya, Japan

[21] Appl. No.: 810,225

[22] Filed: Dec. 17, 1985

[30] Foreign Application Priority Data

Dec. 20, 1984 [JP] Japan ..... 59-270270

[51] Int. Cl.[4] ..... F02P 7/02; H01C 7/10; H01H 19/00

[52] U.S. Cl. ..... 200/19 R; 200/19 DR; 200/19 DC; 338/21

[58] Field of Search ..... 200/19 R, 19 DR, 19 DC, 200/264, 265, 266; 338/21 CC

[56] References Cited

U.S. PATENT DOCUMENTS

| | | | |
|---|---|---|---|
| 4,177,366 | 12/1979 | Kozuka et al. | 200/19 DR |
| 4,369,343 | 1/1983 | Sone et al. | 200/19 DR X |
| 4,393,282 | 7/1983 | Grunwald et al. | 200/19 DC X |
| 4,419,547 | 12/1983 | Imai et al. | 200/19 DR X |
| 4,540,971 | 9/1985 | Kanai et al. | 338/21 |
| 4,581,501 | 4/1986 | Takahashi et al. | 200/19 DR |

FOREIGN PATENT DOCUMENTS

| | | |
|---|---|---|
| 52-119730 | 10/1977 | Japan . |
| 54-38447 | 3/1979 | Japan . |
| 54-50735 | 4/1979 | Japan . |
| 56-6072 | 1/1981 | Japan . |
| 56-75969 | 6/1981 | Japan . |
| 58-88465 | 5/1983 | Japan . |

*Primary Examiner*—J. R. Scott

*Attorney, Agent, or Firm*—Cushman, Darby & Cushman

[57] ABSTRACT

A distributor for an internal combustion engine, wherein a plurality of fixed electrodes which are respectively connected to a plurality of sparking plugs of an internal combustion engines, a rotating electrode rotatable in synchronism with a crank shaft of the internal combustion engine thereby forming sequentially a narrow gap with each of the fixed electrodes, and at least either the fixed electrodes or the rotatable electrode are made of such a ceramic that has the function of a varistor. Thereby the distributor is capable of suppressing noise current caused by spark discharge which is made between the rotating electrode and each of the fixed electrodes.

3 Claims, 8 Drawing Figures

IGNITION DISTRIBUTOR FOR INTERNAL COMBUSTION ENGINES

BACKGROUND OF THE INVENTION

1. Field of the Invention

This invention relates to the improvement in material for use as an electrode of a distributor which conveys a high voltage from the ignition coil to each cylinder of an internal combustion engine. More particularly, it relates to the distributor which is capable of suppressing radio noise caused by spark discharge which is made between the rotating electrode and each of the fixed electrodes.

2. Prior Art

A distributor is a device for conveying a high voltage generated in the ignition coil to each sparking plug in synchronization with the engine processes through spark discharge made in a narrow gap between the rotating electrode and the fixed electrodes.

The current of the spark discharge is composed of capacitive discharge current and induced discharge current.

The capacitive discharg current is a high frequency current which flows instantaneously (for several fractional seconds) with a sharp rise at the instant when the electric charge accumulated in the capacity between the rotating electrode and the fixed electrodes, or accumulated in the floating capacity between the high voltage cable which connects the ignition coil to the rotating electrode and the earth and between the electrodes nearest to the discharge gap and the earth is discharged when dielectric breakdown is caused in the discharge gap (the narrow gap). As a result, the electromagnetic wave caused by the high frequency current is radiated outside, e.g. through the high voltage cable, etc. which serves as an antenna and thereby may cause radio noise.

On the other hand, the induced discharge current is of low frequency (tens to hundreds mA) which flows continuously at the instant when the capacitive discharge ends. Ignition energy supplied to the sparking plugs amounts almost in proportion to the product of the discharge duration time of the induced discharge current and the induced discharge current.

Therefore, the radio noise can be suppressed without losing ignition energy by reducing only the capacitive discharge current.

The capacitive discharge current is reduced by the following conventional methods which have, however, the disadvantages described subsequently:

METHOD (1): employing a resistor

In this method, a resistor is embedded in the rotating electrode or each of the fixed electrodes, or a high resistive layer is formed on the surface of the rotating electrode or each of the fixed electrodes. This method has disadvantages that radio noise suppression effect is small at the high frequency zone up above 300 MHz and ignition energy loss caused by the resistor is large.

METHOD (2): widening the discharge gap

In this method, discharge gap between the rotating electrode and each of the fixed electrodes is widened up to 1.5–6.4 mm.

This method has disadvantages, such as an extremely large loss in ignition energy due to the widening of discharge gap and the corrosion of the electrodes caused by corrosive gas which affects metals, such as nitrogen oxide (NOx) which is generated by higher discharge voltage between the rotating electrode and each of the fixed electrodes, although it has large radio noise suppression effect.

METHOD (3): employing a new material for electrodes

In this method, silicon carbide (Japanese unexamined published patent application No. 119730/1977), ferrite (Japanese unexamined published patent application No.38447/1979), conductive ceramic (Japanese unexamined published patent application No. 75969/1981) or sintered body of a mixture of ceramic and ferrite (U.S. patent application Ser. No. 639,204/1984) is used for at least either the rotating electrode or the fixed electrodes to replace the conventional material of brass.

Noise suppression effect provided by the electrodes made of one of the materials is generally adequate but at the high frequency zone up above 300 MHz it is not sufficient. Also this method has disadvantages, such as large ignition energy loss at too high resistivity, or overcurrent flowing at too low resistivity, and local heating due to the low coefficient of heat transfer which is sufficient enough to affect the durability.

SUMMARY OF THE INVENTION

This invention is an extension of the above "METHOD (3): "employing a new material for electrodes", and contemplates providing such a distributor that has a good radio noise suppression effect with small loss in ignition energy even at the high frequency zone from 300 to 750 MHz by employing a new material for the electrodes to obviate the above disadvantages.

A distributor made according to the present invention takes a relatively simple means of employing a new material for the electrodes to achieve a remarkable radio noise suppression effect, and thus proves to be practically and greatly useful in view of the increasing number of electronic appliances mounted on vehicles and the high prevalence of household electric appliances in the present society.

In short, a distributor according to the present invention employs as a material for its electrodes such a ceramic that has the function of varistor.

The ceramic with the function of varistor used as a main material for the electrodes of the distributor of the present invention reduces the specific resistance of the electrodes in proportion to voltage applied, which allows reduction in energy loss caused to the electrodes at high voltage when ignition current flows as a result of the dielectric breakdown occurred in the discharge gap.

Also the high specific resistance to the high frequency current which flows after the drop of voltage applied between the electrodes suppresses the high frequency current effectively.

According to this invention, bismuth oxide or any of the other additives exist in a form of solid solution among the particles of zinc oxide or any of the other main materials for the electrodes, which form together a peculiar intergranular structure. This intergranular structure has a high impedance to a high frequency while a low impedance to a low frequency, and thereby allows the distributor according to the present invention to achieve a by far better noise current suppression effect at the high frequency zone in comparison with the conventional distributor, which makes this invention useful.

DETAILED DESCRIPTION OF THE INVENTION

This invention contemplates reducing capacitive discharge current which may cause noise current by employing as a material for the electrodes such a ceramic that has the function of a varistor.

Figure 1:
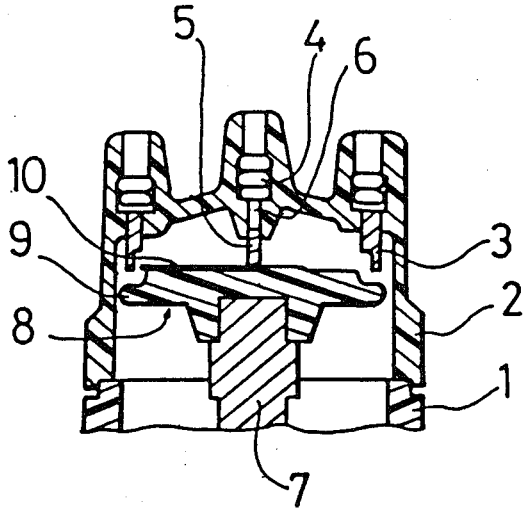
FIG. 1 is a cross sectional view showing the practical structure of a distributor according to an embodiment of the present invention.

FIG. 1 is a cross sectional view of a distributor constructed according to an embodiment of the present invention.

According to this invention, the distributor has:

- a plurality of fixed electrodes 3 respectively connected to each of the sparking plugs for an internal combustion engine, and
- a rotating electrode 10 which is arranged so as to oppose each of the fixed electrodes 3 and thereby form a narrow gap sequentially with each of them while it rotates in a motion synchronized with the crank shaft of the internal combustion engine, and
- is featured by the fact that at least either the fixed electrodes 3 or the rotating electrode 10 are made of such a ceramic that is provided with the function of a varistor.

The distributor comprises a housing 1 and a distributor cap 2 made of an insulating material and attached to the housing 1. Provided in the upper end of the distributor cap 2 are fixed electrodes 3 which project from the cap at regular intervals. The fixed electrodes 3 are respectively connected to each ignition plug which is not shown in this figure with a high voltage capable which is not shown either in this figure. Provided at the center of the upper end of the distributor cap 2 is a central terminal 4 which projects from the cap. The central terminal 4 is connected to the secondary coil of an ignition coil which is not shown in this figure. Disposed at the end of the central terminal 4 is a conductive spring 6 which is provided with a slider 5 composed of carbon and movably supported by the distributor cap. The housing 1 and the distributor cap 2 define a hollow space in which a cam shaft 7 is situated. The cam shaft 7 is rotated in synchronism with a crank shaft of the internal combustion engine. Mounted on the upper end of the cam shaft 7 is a distributor rotor 8. The distributor rotor 8 comprises of an insulating substrate 9 (rotor) and an electrode 10 which is disposed on the upper surface of the insulating substrate 9. One end of the electrode 10 is connected with the slider 5, pressurized by the conductive spring 6.

The rotating electrode 10 is rotated in accordance with the rotation of the distributor rotor 8 in such a manner that the rotating electrode 10 sequentially opposes each of the fixed electrodes 3 so as to form a narrow gap (discharge gap) with them. When the rotating electrode 10 opposes one of the fixed electrodes 3 through a narrow gap therebetween, which constitutes the state as shown in FIG. 1, a high voltage generated by the ignition coil is applied to the central terminal 4. Thereby a spark discharge is produced at the narrow gap due to the dielectric breakdown occurred in the air. Simultaneously, discharge occurs at the spark gap within the spark plug which is connected with the aforesaid narrow gap in series. Thus the desired ignition operation can be performed.

According to the present invention with the above composition, such a ceramic that has the function of varistor with extremely large variation of current I to voltage V is used as the main material for the electrode so as to reduce the peak value of the capacitive discharge current which may cause radio noise and the energy loss of the electrodes.

The ceramic electrode employs as the main material at least one of zinc oxide (ZnO), magnesium oxide (MgO), calcium oxide (CaO) and nickel oxide (NiO) and as an additive at least one of bismuth oxide ($Bi_2O_3$), manganese dioxide ($MnO_2$) and cobalt oxide (CoO), and is formed by sintering.

Figure 2:
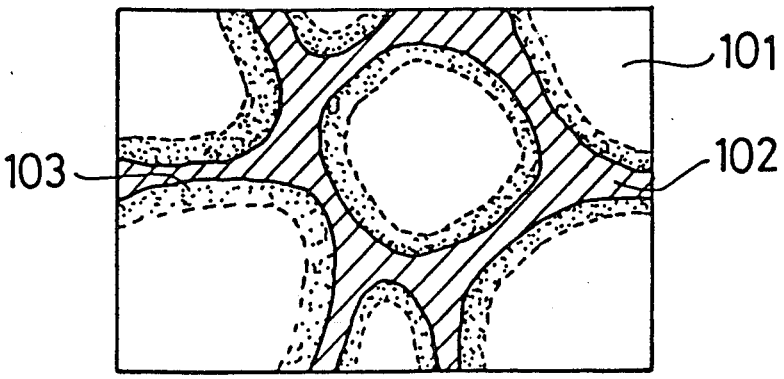
FIG. 2 is a structural view showing the microscopic structure of the material for the electrodes used in an embodiment of the present invention.
Figure 3:
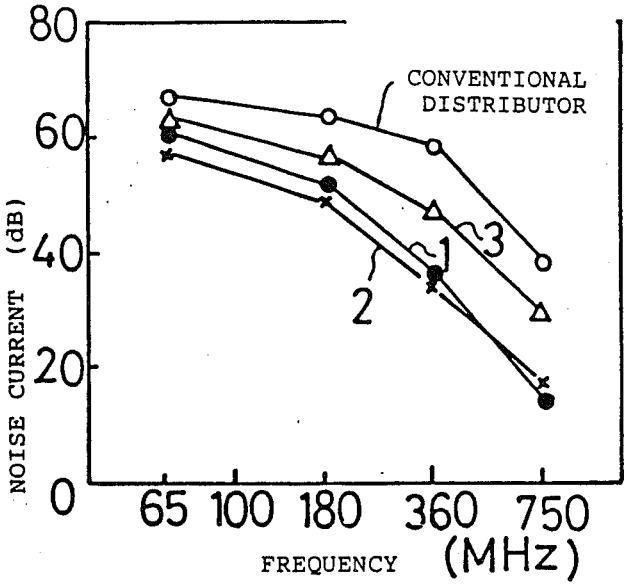
FIGS. 3 through 6 are comparative graphs showing the interrelation between frequency and radio noise of a distributor according to the embodiment of the present invention and of a conventional type of distributor.
Figure 4:
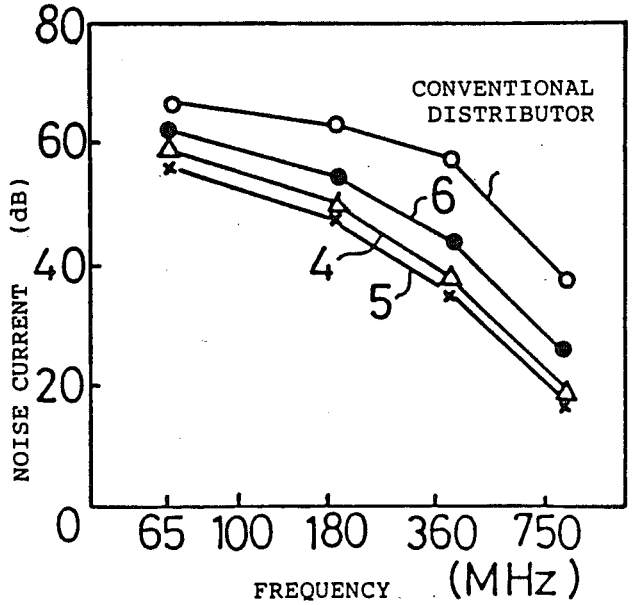
Figure 5:
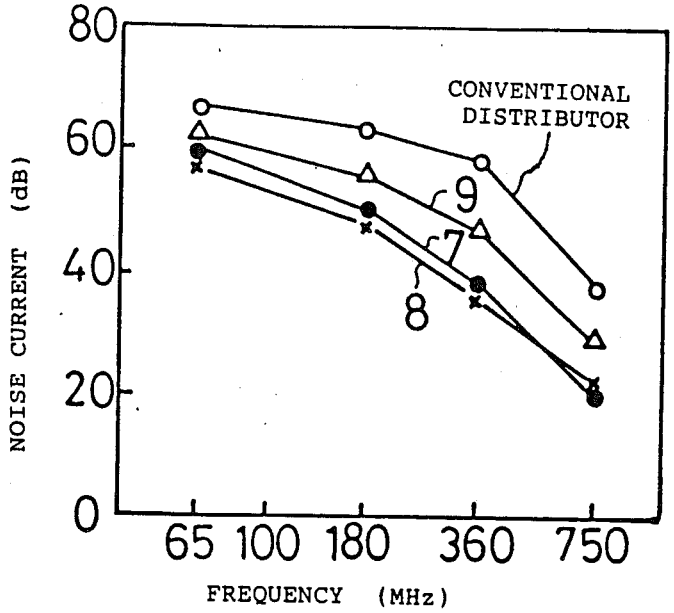
Figure 6:
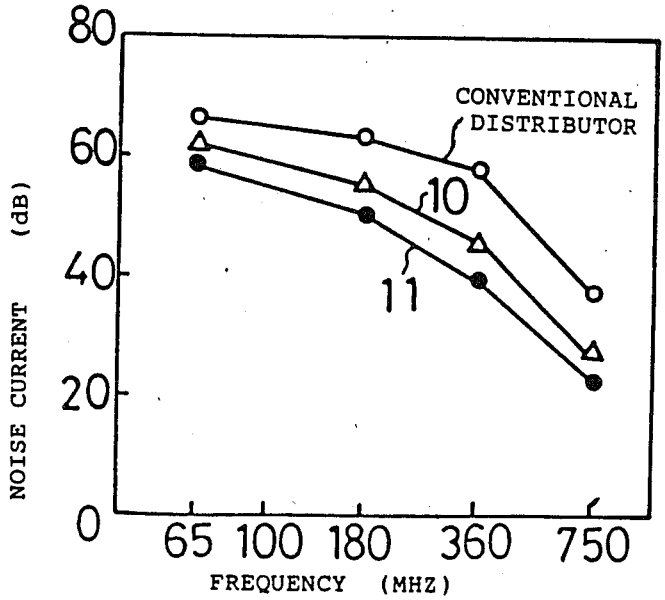

FIG. 2 is a structural view showing the microscopic structure of the material for the electrode used in an embodiment of the present invention. In the desirable condition of this invention in execution, additive 102 such as bismuth oxide ($Bi_2O_3$) exists among the granules 101 of the main material such as zinc oxide (ZnO) thereby forming a peculiar granular structure in solid solution 103. With high impedance at high frequency, this granular structure 103 is capable of suppressing high frequency capacitive discharge current, while the impedance is low to low frequency. From this fact, it is deemed that the electrode has little energy loss.

DETAILED DESCRIPTION OF THE PREFERRED EMBODIMENTS

In the following passages, the embodiments of this invention will be described with specific examples.

(Preparation for examples)

Examples were made in accordance with the following procedures:

(1) Preparation for materials

Those material listed in the below table were weighed to make a 1 kg bit for each example (Examples 1 through 11). Each bit was put into a pot mill of 5 lit. in capacity and pulverized for 24 hours with 1.5 lit. water added until it makes a slurry. The slurry thus made was dried on a drying basin, added with a binder for 1 wt% (to the material) and granulated to be mean 50 microns in diameter.

TABLE

| EXAMPLE | (wt %) MAIN MATERIAL | | ADDITIVE | | |
|---|---|---|---|---|---|
| NO. | ZnO | NiO | $MnO_2$ | $Bi_2O_3$ | CoO |
| 1 | 99 | | | 1 | |
| 2 | 98 | | | 2 | |
| 3 | 99.5 | | | 0.5 | |
| 4 | | 99 | | 1 | |
| 5 | | 98 | | 2 | |
| 6 | 99 | | 1 | | |

TABLE-continued

| EXAMPLE NO. | MAIN MATERIAL (wt %) ZnO | NiO | ADDITIVE $MnO_2$ | $Bi_2O_3$ | CoO |
|---|---|---|---|---|---|
| 7 | 99 | | 0.5 | 0.5 | |
| 8 | 90 | 8 | | 2 | |
| 9 | 90 | 5 | 4 | 1 | |
| 10 | 99 | | | | 1 |
| 11 | 98 | | | | 2 |

(2) Forming

The granulated materials thus prepared were respectively processed to the shape of the rotating electrode 10 for a distributor as shown in FIG. 1 under a pressure of 600 kg/cm$^2$.

(3) Sintering

The electrodes thus formed were respectively sintered in an oxidation atmosphere at 1,280°–1,350° C. for 1–2 hours.

(4) Burning

The electrodes thus sintered were respectively trimmed to the specified dimension. Silver was burned on a part of the surface portion of the rotating electrode with which the central electrode is in contact.

(5) Fixing

The ceramic rotating electrodes 10 thus formed were respectively fixed to the plastic rotor 9 as shown in FIG. 1 by means of ultrasonic welding or a bonding agent to obtain Examples 1 through 11.

(Evaluation)

Figure 7:
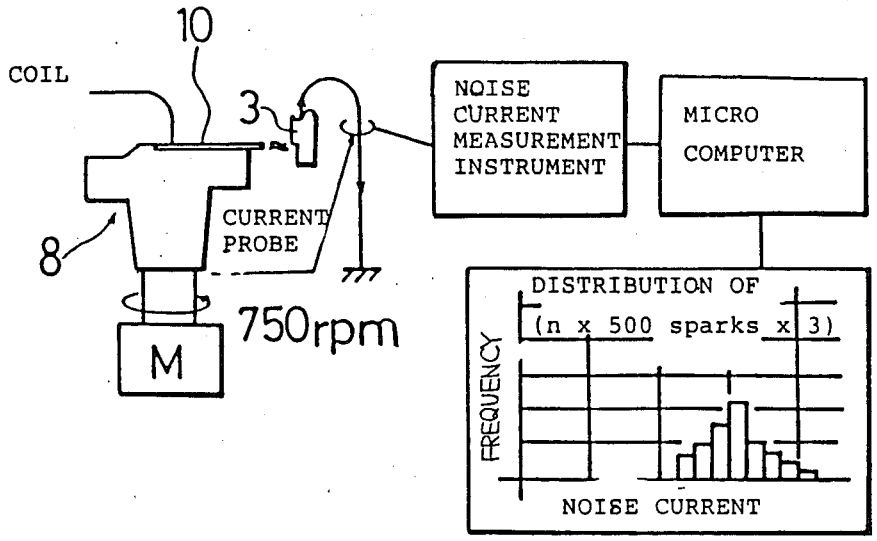
FIG. 7 is a descriptive chart showing the measurement principle for noise current.

FIGS. 3–6 are comparative graphs showing the measured noise current of the Examples made according to an embodiment of the present invention and a conventional distributor with the electrodes made of brass. FIG. 7 is a descriptive chart of the radio noise measuring principle. In accordance with this chart, while rotating the rotating electrode 10 at 750 rpm with a high voltage applied from the ignition coil, the noise current discharged through the discharge gap is measured at the fixed electrodes. For reference purpose, the criterion of 0 dB in FIGS. 3 through 6 is set in 1 V/m.

As shown in FIGS. 3 through 6, the distributors according to an embodiment of the present invention (Examples 1 through 11) were proved to be better in suppression of radio noise particularly at the high frequency zone up above 300 MHz in comparison with the conventional distributor. This is presumably because the additive 102 such as bismuth oxide ($Bi_2O_3$) in solid solution exists among the main material 101, such as zinc oxide (ZnO), takes a peculiar granular structure 103, which results in higher impedance to high frequency and better suppression of high frequency radio noise.

At the low frequency, however, the impedance is not so high as above and, as a result, the ignition energy loss is so small that it allows adequate energy for sparking.

Figure 8:
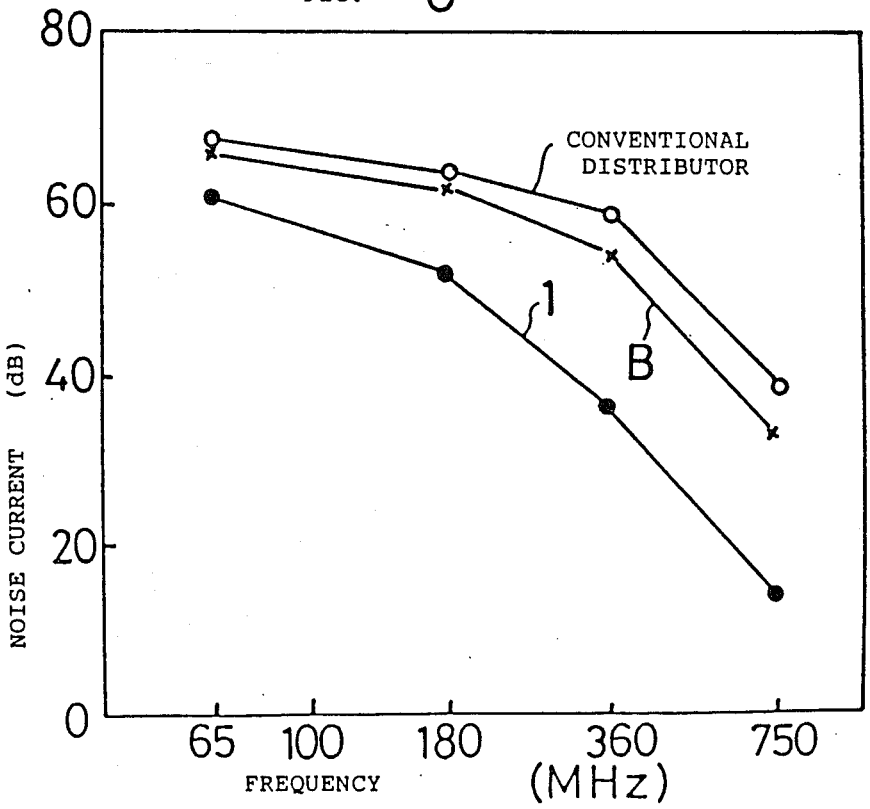
FIG. 8 is a comparative graph showing the interrelation between frequency and radio noise of a distributor according to the embodiment of the present invention, a conventional type of distributor, and a distributor which uses zinc only as a material for its electrodes.

FIG. 8 is a comparative graph showing the difference in noise current level between a distributor (B in the figure) which is provided with a rotating electrode 10 made of zinc oxide (ZnO) only, which is one of the above main materials, without adding any additive such as bismuth oxide ($Bi_2O_3$), and the distributor according to an embodiment of the present invention (Example 1).

The electrodes of the distributor B neither contain a solid solution of including bismuth oxide ($Bi_2O_3$) among the granules of zinc oxide (ZnO) nor have the above granular structure that is revealed in this invention. Therefore, as shown in FIG. 8, the distributor is inferior to the distributor according to the embodiment of the present invention in the noise current suppression effect at the high frequency zone.

What is claimed is:

1. A distributor comprising:

a plurality of fixed electrodes adapted to be electrically connected to a plurality of sparking plugs of an internal combustion engine, and a rotating electrode adapted to be rotatable in synchronism with a crank of the internal combustion engine and forming a narrow gap sequentially with each of the said fixed electrodes, wherein it is featured that at least one of said plurality of fixed electrodes and said rotating electrode is made of a ceramic that has the function of a varistor and has as a main material at least one of zinc oxide (ZnO) and nickel oxide (NiO) and as an additive at least one of bismuth oxide ($Bi_2O_3$), manganese dioxide ($MnO_2$) and cobalt oxide (CoO), which are sintered together.

2. A distributor according to claim 1, wherein said ceramic contains said additive among the granules of said main material.

3. A distributor according to claim 1, wherein said ceramic has over the surface of the granules of said main material a granular structure that is composed of a solid solution of said main material and said additive.

* * * * *